US010371153B2

(12) United States Patent
Shuy et al.

(10) Patent No.: US 10,371,153 B2
(45) Date of Patent: Aug. 6, 2019

(54) MULTI-PUMP SYSTEM WITH SYSTEM CHECK

(71) Applicant: LT LIGHTING (TAIWAN) CORP., Xiangshan Dist., Hsinchu (TW)

(72) Inventors: Geoffrey Wen-Tai Shuy, Taipei (TW); Wen Ten Chang, Kaohsiung (TW); Jau-Dar Liao, Miaoli (TW); Hsin-Chen Lai, Taichung (TW); Chang-Horang Li, Hsinchu (TW); Ming Huei Lu, Taipei (TW)

(73) Assignee: LT LIGHTING (TAIWAN) CORP., Hsinchu (TW)

( * ) Notice: Subject to any disclaimer, the term of this patent is extended or adjusted under 35 U.S.C. 154(b) by 0 days.

(21) Appl. No.: 16/124,010

(22) Filed: Sep. 6, 2018

(65) Prior Publication Data

US 2019/0085847 A1 Mar. 21, 2019

Related U.S. Application Data

(63) Continuation-in-part of application No. 15/600,580, filed on May 19, 2017.

(51) Int. Cl.

| | |
|---|---|
| ***F04D 13/06*** | (2006.01) |
| ***F04B 23/02*** | (2006.01) |
| ***F04B 23/04*** | (2006.01) |
| ***F04D 13/12*** | (2006.01) |
| ***F04D 15/00*** | (2006.01) |
| ***F04D 15/02*** | (2006.01) |
| ***F04B 49/06*** | (2006.01) |

(52) U.S. Cl.

CPC ..... *F04D 13/068* (2013.01); *F04B 23/02* (2013.01); *F04B 23/04* (2013.01); *F04B 49/065* (2013.01); *F04D 13/12* (2013.01); *F04D 15/0005* (2013.01); *F04D 15/0236* (2013.01); *F04D 15/0088* (2013.01); *F04D 15/0281* (2013.01)

(58) Field of Classification Search

CPC ..... F04B 23/02; F04B 23/04; F04B 49/065; F04D 13/068; F04D 13/12; F04D 13/14; F04D 15/0005; F04D 15/0088; F04D 15/0236; F04D 15/0281; F04D 15/029

See application file for complete search history.

(56) References Cited

U.S. PATENT DOCUMENTS 2,797,702 A * 7/1957 Martin ..... G05D 9/12 137/392
6,325,093 B1 * 12/2001 Ooshima ..... G05D 7/0682 137/392
6,953,329 B2 * 10/2005 Rardin ..... F04D 25/08 417/411

(Continued)

*Primary Examiner* — Patrick Hamo
*Assistant Examiner* — Joseph S. Herrmann
(74) *Attorney, Agent, or Firm* — Workman Nydegger

(57) ABSTRACT

Design solutions to mitigate the following four fatal flaws in the conventional pump system design; namely, (1) surprise pump-failure in single pump designs that can result in costly water damage; (2) the threat of fatal high voltage electrocution due to flooding; (3) grid power outage and no energy supply to support the needed pumping power that results in water damage; (4) foil odor from the standing water in the well after a period of low seeping rate with or without activated pumping. The principles described herein can completely mitigate the above four fatal design issues.

19 Claims, 10 Drawing Sheets

(56) References Cited

U.S. PATENT DOCUMENTS

| | | | | |
|---|---|---|---|---|
| 8,444,394 | B2 * | 5/2013 | Koehl | F04D 15/0088 417/53 |
| 8,474,477 | B1 * | 7/2013 | Melisz, Jr. | E02D 29/12 137/363 |
| 8,639,391 | B1 * | 1/2014 | Alberth, Jr. | G05B 15/02 340/657 |
| 9,181,953 | B2 * | 11/2015 | Steger | F04D 15/0066 |
| 2017/0254333 | A1 * | 9/2017 | Shuy | F04D 13/08 |

* cited by examiner

MULTI-PUMP SYSTEM WITH SYSTEM CHECK

CROSS-REFERENCE TO RELATED APPLICATIONS

This patent application is a continuation-in-part of U.S. patent application Ser. No. 15/600,580, filed May 19, 2017, which patent application is incorporated herein by reference in its entirety.

BACKGROUND

Millions of houses in the United States of America are built with a basement. Many of these houses use a pump system that operates from a sunk well below the basement floor. Such a pump system is referred to as a "sunk" pump system. A sunk pump system operates to pump water that has leaked from outside (e.g., due to a high water table, flooding, or other forms of leakage) and that has thus gathered into the sunk well in the basement. The pumped water is channeled out back out of the house, thereby allowing the basement to stay dry.

The typical existing sunk pump system is powered by a high voltage electrical grid to which the houses are connected. Such existing pumps often comprise a single pump that operates at a fixed pumping rate, and which has a capacity that meets the anticipated worst-case flooding conditions. The pump is typically activated by a "high" water level sensor to pump water in the sunk well to the outside. After activation, the pump is stopped upon a "low" water level sensor being triggered. The typical existing pump system is referred hereinafter as "the conventional pump system".

If the convention pump system has insufficient pumping to accommodate a large volume of water flooding into the house, the inadequate pumping can result in water damage. Likewise, if there is an unexpected pump failure, or a period of grid power outage, the pump will not operate at all, again resulting in water damage. Such water damage can typically cost thousands of dollars to repair. Furthermore, when there is a low seeping rate, and the pump is not activated for a long period of time, the relatively stagnant water can begin to emit a musty and foul odor, thereby diminishing the quality of life of the occupants.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Statistically speaking, when using the conventional pump system, the most frequent cause of serious water damage is due to unexpected pump failures that lead to basement flooding. Unexpected pump failure is the Akeley's heel of the conventional pump system which operates using a single pump. The second most frequent cause of major water damage when using the conventional pump system is due to grid power outages. But use of the conventional pump system also has other potential concerns, in addition to water damage. For instance, there is a threat of high voltage electrocution when there is flooding.

The principles described herein comprise a pump system of multiple smaller pumps, and that only turns on or off pumps at the granularity down to a single pump to better match the water seeping rate. This system reduces the severe consequences of pump failure, since redundant pumps now exist in case of failure of any given pump. To mitigate the risk of electrocution and exposure to grid power outage, the embodiments of the pump system convert the high voltage (e.g., above 100 volts) AC grid power to a low voltage (e.g., below 72 volts) DC power and then temporarily stores the power in an energy reservoir. This DC energy reservoir supplies a low voltage DC power for the pump system together with the grid power that is converted into the charging DC power. During a grid power outage, the reservoir alone can provide the needed emergency power to the pump system (e.g., as an UPS but without an inverter) for a design duration time (e.g., six hours). Thus, the proposed design concept not only provides pumping power support during grid power outage; but also alleviates the threat of high voltage electrocution in basement flooding situations.

Embodiments described herein also may use a regulator to manage the charging and discharging of the reservoir. As described later, a system check device may perform a scheduled periodic check on the system's functions according to a designed procedure, and uses a communication device to send out the findings so as to prevent flooding due to unexpected pump failure. The proposed system check and communication devices can also monitor/detect in real time and send out proper messages when important incidents occur. These events might include pump failure during normal operation, grid power outage and recovery, water influx rate exceeding the pump system's capacity, and so forth. When these events occur, the messages are sent out to a person or persons (as specified by the owner) via channels (as also specified by the owner) such that someone can judge what action he/she should take to minimize the upcoming consequence. For instance, an individual might choose to rush to the house to contain the water damage at its early stage.

The principles described herein can also correct at least two other shortcomings of the conventional pump system design. First, a single big pump is designed with a fix pumping rate to handle the largest anticipated water leak-in flow. As a result, during the normal seeping rate, there is a periodic short pulsed start-then-stop pumping action that can shorten the motor's life and also waste a lot of electric energy. The system described herein turns on or off the small pumps one by one at the granularity of a single pump to better match the seeping rate that results in much less wasteful motor actions. Secondly, a single big pump is designed with no spare pumping capacity to handle a larger than designed maximum seeping rate. Even if the seeping rate exceeds the pumping rate by just 10% for a short time; there may still be water damage. The system described herein can have a total maximum pumping rate that equals or exceeds the single pump capacity of the conventional pump system, and then add at least one pump as a system's "assurance spare"; resulting in a higher capacity.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features can be obtained, a more particular description of various embodiments will be rendered by reference to the appended drawings. Understanding that these drawings depict only sample embodiments and are not therefore to be considered to be limiting of the scope of the invention, the embodiments will be described and explained with additional specificity and detail through the use of the accompanying drawings in which.

DETAILED DESCRIPTION

Section One: Conventional Pump Systems.

Statistically speaking, when using the conventional pump system, the most frequent cause of the serious water damages is due to unexpected pump failures that lead to basement flooding. Unexpected pump failure is the Akeley's heel of the conventional pump system which operates using a single pump. The second most frequent cause of major water damage when using the conventional pump system is due to grid power outages. But use of the conventional pump system also has other potential concerns, in addition to water damage. For instance, there is a threat of high voltage electrocution when there is flooding.

Figure 1A:
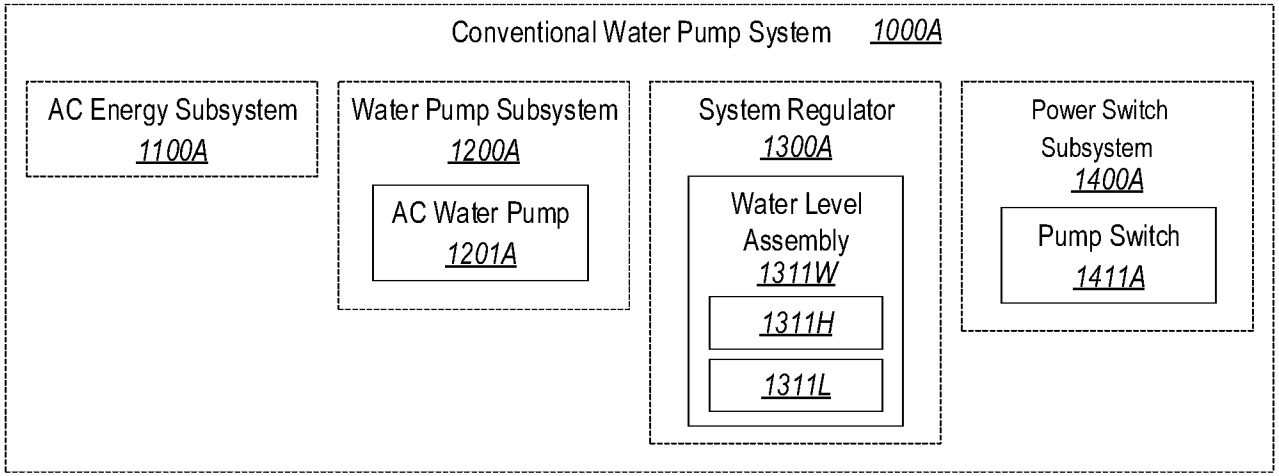
FIG. 1A PRIOR ART
FIG. 1A schematically illustrates a conventional pump system.
Figure 1B:
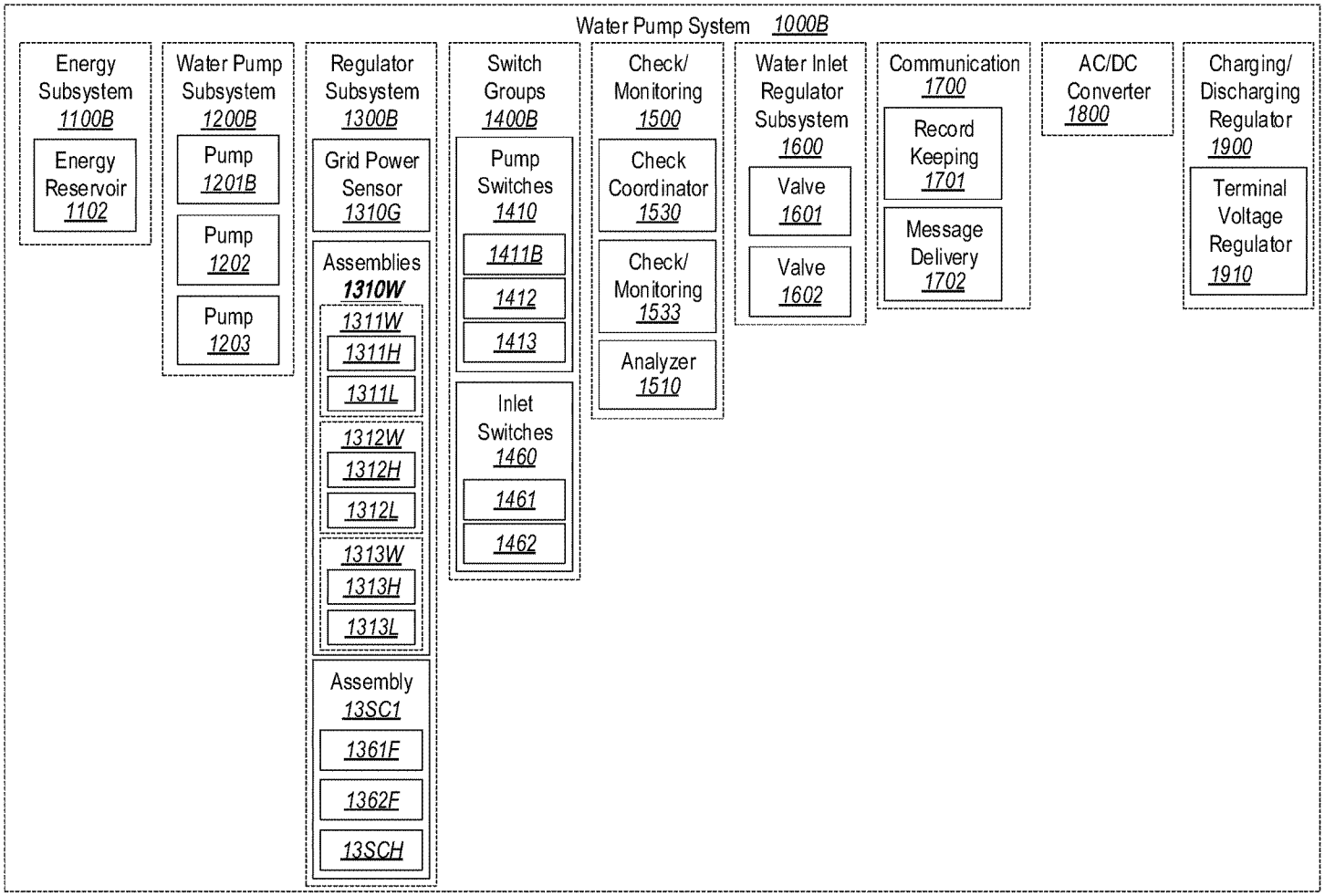
FIG. 1B schematically illustrates an embodiment of a pump system in accordance with the principles described herein, and may be compared with FIG. 1A to show the novel differences.

FIG. 1A schematically illustrates a conventional pump system 1000A. In contrast, FIG. 1B schematically illustrates an embodiment of a pump system 1000B in accordance with the principles described herein. As depicted in FIG. 1A, a conventional pump system 1000A includes (1) a power supply subsystem (or "energy subsystem") 1100A to supply AC electric power from a high voltage power source; (2) a water pump subsystem 1200A consisting of a single AC-powered water pump 1201A to pump the water in a sunk well; (3) a system regulator 1300A consisting of single water level sensor assembly 1311W in which there is built-in a pair of high/low water level sensors 1311H and 1311L; and (4) a power switch subsystem 1400A consisting of a single pump switch 1411A.

The AC electric power supply subsystem 1100A connects through the pump switch 1411A to power the AC-powered pump 1201A. The switch 1411A is activated by the high level sensor 1311H to turn on the electric power supply to drive the pump 1201A; and is deactivated by the low water level sensor 1311L to turn off the electrical power supply to stop the pump 1201A.

Typically, the water pump 1201A is powered by the high voltage AC power of an electrical grid. The water level sensor assembly 1311W is often a buoy-spring device that uses the water buoyancy to detect water levels. When water reaches above the location of the buoy, the buoy-weight is reduced by the water buoyancy. On the other hand, when the water level falls below the buoy location, the buoy recovers its normal weight. This weight difference activates the spring and produces a distinct high/low signals that turn the switch 1411A on and off.

Typically, a single assembly contains the switch 1411A and the water level sensors 1311W as a combined unit and is named as the "pump-control-switch" assembly in the art; and is referred to as "the assembly" or "assembly module" herein. As used herein, the assembly module has the same labels as the water level sensor in each of FIGS. 1A and 1B. Accordingly, the water level sensor (or the same numbered assembly module) can also send out control signals herein, unless otherwise specified. As example, "the assembly" that combines the switch 1411A and the water level sensor 1311W is also numbered as assembly 1311W; and can also send out signals for control functions in FIG. 1A. Likewise, the assemblies that respectively combine the switches 1311W, 1312W, and 1313W of FIG. 1B can send out signals for control functions of respective pumps 1201B, 1202 and 1203, respectively, of FIG. 1B.

To reiterate, the conventional pump designs use an AC grid power to drive a single big pump controlled by a single pump-control-switch assembly. When a water level reaches above a high level, the assembly turns on the switch and sends in the AC power to drive the pump to pump water. When the water level falls below a low level, the assembly turns off the power to the pump to stop pumping of the water. Thus, any unexpected grid power outage, or assembly failure, or pump failure could allow basement flooding to occur; causing significant damage, and introducing a chance of high voltage electrocution.

Section Two: Pump System in Accordance with the Principles Described Herein.

As an embodiment depicted in FIG. 1B, water pump systems 1000B that incorporate the principles described herein include a power supply subsystem 1100B that, unlike the conventional pump system 1000A, supplies low voltage (e.g., 36 volts DC) electrical power. Furthermore, unlike the conventional pump system, the power supply subsystem 1100B also includes an energy reservoir 1102. Also, unlike the conventional pump system, the water pump system 1000B includes a water pump subsystem 1200B that includes multiple water pumps (three pumps 1201B, 1202, and 1203 in the illustrated example) to pump the water from a well. For instance, the water pumps 1201B, 1202 and 1203 may be positioned in the basement of a residence, within a basement well. The water pump system 1000B further includes a subsystem of regulators 1300B to regulate management functions of the pump system. The water pump system 1000B further includes switch groups 1400B consisting of groups of switches. Each switch can be activated to turn on or turn off the electric power that is supplied to a specific module when dictated.

The water pump system 1000B also includes a subsystem of a check/monitoring device 1500 to perform the designed functional checking and monitoring for specific individual subsystems or modules; a valve (or "water inlet regulator") subsystem 1600 to turn on/off fresh water inlet through a group of valves in the procedure of system check and flushing; a communication module 1700 to deliver proper communications to people of concern; an AC to DC converter 1800 to convert AC power to charge the reservoir 1102; and a charging/discharging regulator 1900 to regulate the charging and discharging of the energy reservoir 1102 in the energy subsystem 1100B. The functions of the above subsystems, devices, components, and modules will be described later.

In lieu of being designed and equipped with only one big pump 1201A as in the conventional pump system, the principles described herein uses multiple smaller pumps (say, 1201B, 1202, and 1203 as depicted in FIG. 1B). Note that pump 1201B of the water pump system 1000B is different (e.g., smaller and/or DC powered) than the single pump 1201A of the convention pump system 1000A and thus has a different label. The power delivery routes to these pumps are controlled by a group of pump-control-switch assemblies (or the "assemblies") 1311W, 1312W and 1313W, respectively. The total maximum capacity of the multiple small pumps is proposed to be equal to or just exceed the anticipated worst influx rate, and thereto add at least one additional pump as the "assurance spare" pump(s) to mitigate the consequence of pump failure (e.g., water damage in the basement) that might occur in the middle of operation or other unexpected situations. In the embodiment depicted in FIG. 1B, the total pumping capacity of the pumps 1201B and 1202 is equal to or exceeds of the capacity of anticipated worst water in-flux rate; while the pump 1203 is the "assurance spare" pump.

FIG. 1B depicts the proposed multiple pump system 1000B with 3 smaller pumps and the additional devices 1500 and 1700, which are absent in the conventional pump system depicted in FIG. 1A. As described above, unexpected pump failure is the Akeley's heel of the conventional pump system 1100A which operates using a single pump 1201A. In accordance with the multiple pump system described herein, the consequence of expected single pump failure is definitively much less than those of the conventional pump system designs; especially when there is an additional assurance spare pump. Even so, the addition of the devices of the system checking/monitoring subsystem 1500 and the communication subsystem 1700 can even further reduce the consequence of an unexpected single pump failure. Thus, the multiple pump system as described herein clearly improves the technical state of the art.

The regulator subsystem 1300B comprises sensors that include a sensor 1310G to detect the grid power outage and recovery. The regulator 1300B also includes a group 1310W of level sensing assemblies (e.g., sensors 1311W, 1312W, 1313W, and so forth). These level sensing assemblies 1310W are positioned to detect water levels and are thus also referred as "the water level sensors" herein. A switch and a pair of high/low water level sensors may be built into each of these level sensing assemblies. As examples, the assembly 1311W may have a built-in switch 1411B and high/low water level sensors 1311H and 1311L that controls the power delivery of the pump 1201B. The assembly 1312W may have a built-in switch 1412 and high/low sensors 1312H and 1312L that controls the power delivery of the pump 1202. Likewise, the assembly 1313W may have a built-in switch 1413 and high/low sensors 1313H and 1313L that controls the power delivery of the pump 1203. Such continues for as many pumps as there may exist in the multiple pump system 1000B. The regulator subsystem 1300B also includes a system check assembly 13SC1, that includes two flow sensors 1361F and 1362F, and high level sensor 13SCH.

Figure 2:
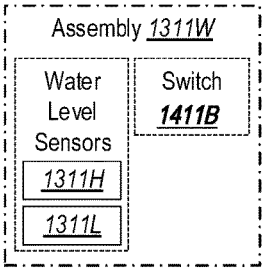
FIG. 2 schematically illustrates an assembly that includes water level sensors and a corresponding switch, and which may operate within the pump system of FIG. 1B.

The working principle of these assemblies can be the same as the buoy-spring plus switch assembly described in the previous section (Section One). Thus, these assemblies (1311W, 1312W, 1313W, and so forth) can also send out water level signals to control devices to perform the designed control functions. FIG. 2 depicts the assembly 1311W consisting of high/low water level sensors 1311H, 1311L and assembly 1411B that can also send out control signals. The assemblies 1312W and 1313W may be similarly structured, each with their respectively high/low water level sensors and switch.

For instance, when the seeping rate increases such that water level reaches the high water level 1311H; the sensor activates the switch 1411B to turn on the electric power to drive the pump 1201B. When the water level increases further to reach above another high water level 1312H (located above the first high water level 1311H), the sensors 1312H further activates the switch 1412 to turn on the electric power to drive pump 1202 (in addition to pump 1201B being driven by switch 1411). When the combined pumping and seeping rate results in a decreasing water level; and the water level decreased to below the sensor 1312L but above the sensor 1311H, the sensor 1312L activates the switch 1412 to turn off the pump 1202; but the sensor 1311H can still keep the pump 1201B running.

As described, the design of the embodiment FIG. 1B is equipped with 3 assemblies (1311W, 1312W, and 1313W) to control the 3 pumps (1201B, 1202, and 1203) that can be turned on/off to better matching the seeping rate to adequately handle the anticipated maximum seeping rate (pump 1201B plus pump 1202); and also have at least one more assurance spare pump (pump 1203) for purposes described above.

Section Three: System Checking:

At a specified schedule, the regulator system 1300B performs a system check. At the specified scheduled check time, the regulator 1300B activates the system check module 1530 as the system check coordinator. The system check module 1530 then sends out a signal to activate the communication device 1700 so as to register this activation into the record keeping module 1701, and activates the system check/monitoring device 1533 to perform the scheduled system check. After finishing the system check, the coordinator device 1530 activates the message delivery component 1702 to send out the finalized check report.

As an example, when the system check shows normal operation, the finalized check report might be "The water pump system of [name or address] performed a scheduled system check at [yy/mm/dd/hh] (dating the year, the month, the day, and the hour). The results are as follows: All subsystems are in normal condition.". As another example, when the system check shows the pump 1202 and/or its related control assembly is not operating normally, the finalized check report might be "Alert!! The system check of the water pump system of [name or address] reports the following malfunction(s): pump 1202 not functioning". As yet another example, when the system check failed to finish at the scheduled time, the finalized check report might be "Alert!! The system check of the water pump system of [name or address] did not perform its scheduled system check".

Section Four: Pump Check Procedure:

Since the reliability of each subsystem may be very different, the subsystem checks may be performed at different frequencies. For instance, the check of the pump subsystem may be performed semiannually while the check of the energy reservoir may be performed every season (e.g., quarterly). Also, the fresh water inlet flow rate might be adjusted such that the flow rate is less than the designed worst flooding rate (e.g., less than the total pumping capacity of pumps 1201B and 1202).

During the pump check, the checking and monitoring subsystem 1500 activates the check coordination device 1530 (depicted in FIG. 1B) to coordinate the pump checking. As the starting point, the subsystem 1500 records the system's running state into the record keeping module 1701. For instance, at the initial state of pump check, pump 1201B is running—but pumps 1202 and 1203 are not. The device 1530 keeps the system running state as is; and starts to perform the pump checking procedure. At the end of pump check, the subsystem 1500 resets back to the initial running state. The following checking sequence assumes the initial state is as stated above (i.e., pump 1201B is running, but pumps 1202 and 1203 are not).

Figure 3:
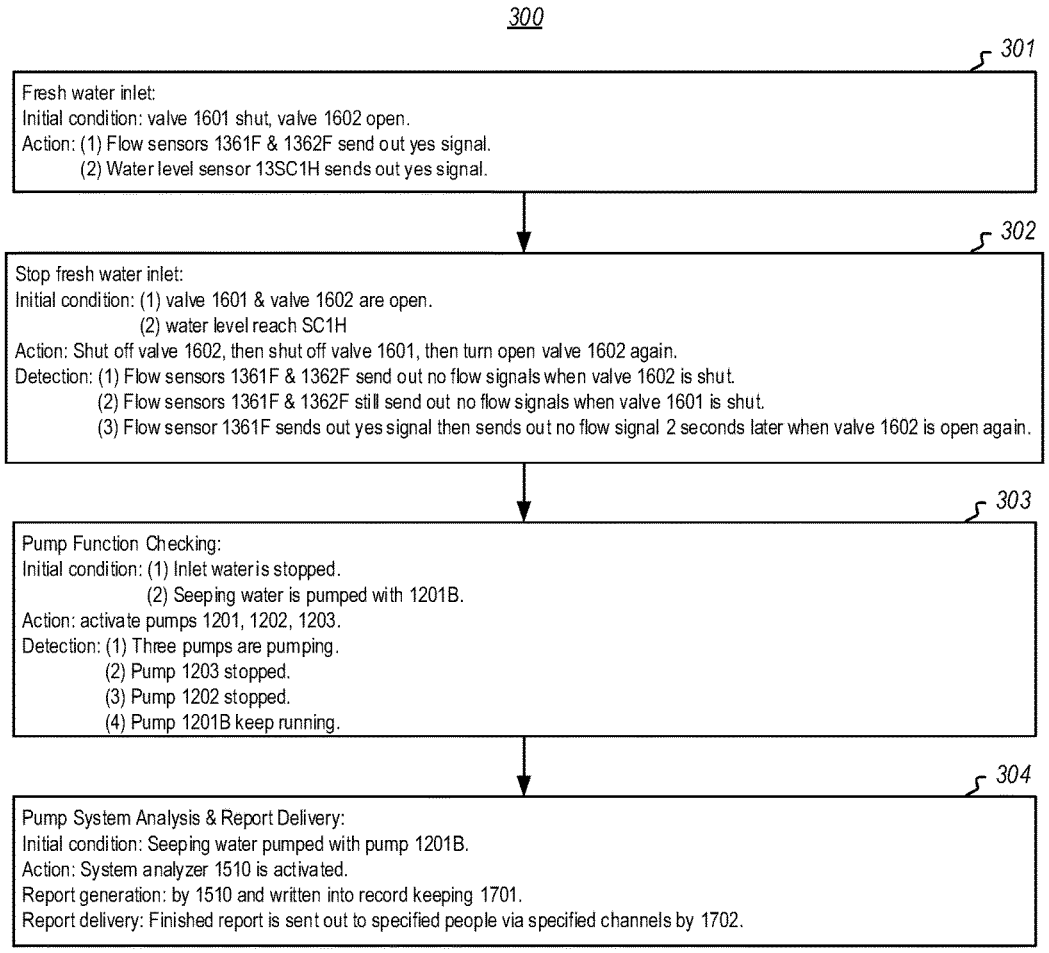
FIG. 3 illustrates a flowchart of method for checking a pump function in accordance with the principles described herein.

FIG. 3 illustrates a flowchart of method 300 for checking a pump function in accordance with the principles described herein. Depicted in the starting step 301 (i.e., the fresh water inlet step), the system check coordinator 1530 activates a fresh water inlet regulator 1600 to let-in the fresh water through a set of series-connected valves 1601 and 1602, which are respectively controlled by inlet switches 1461 and 1462. At the initial state, the valve 1601 is shut while the valve 1602 is open. The water inlet regulator 1600 activates the valve 1601 to open its valve such that fresh water can flow through valve 1601 (detected by flow sensor 1361F) and valve 1602 (detected by flow sensor 1362F) and into the well. Signals of water flow through valve 1601 and 1602 are sent out by flow sensors 1361F and 1362F of the assembly 13SC1 to the coordinator 1530 and are recorded by the record keeping module 1701 indicating the water inlet valves properly opened. Commercial water flow sensors are available. For instance, they are used in the flow activated gas ignitor of water heaters or in flow activated electric shower heaters.

Thereafter, the water level may then be increased to reach a designed water-level (level SC1H at the assembly 13SC1). The level SC1H is higher than the highest pump control assembly (level 1313H as in the embodiment of FIG. 1B). The assembly 13SC1 sends out a signal to the coordinator 1530 when the water level reaches level SC1H, resulting in the event being recorded by the record keeping module 1701, which indicates that the inlet step 301 has been performed and is completed. The coordinator 1530 then performs the step 302 (the step of shutting off the water inlet).

As depicted in step 302, the water inlet regulator 1600 activates the valve 1602 to shut off such that fresh water cannot flow through valve 1602. The resulting lack of flow is detected by flow sensor 1362F, and a resulting signal that the water flow is off is then set to water inlet regulator 1600. The water inlet regulator 1600 then activates the valve 1601 to shut off. When valve 1601 is completely shut off, and the signal sent to the water inlet regulator 1600, the water inlet regulator 1600 then activates the valve 1602 to reopen. If the valve 1601 is shut off and the valve 1602 is indeed reopened, then for a short while, there will be some water flow detected by flow sensor 1362F but not by flow sensor 1361F. However, after a proper time delay, the water flow sensors 1361F and 1362F sense no fresh water flow through valves 1601 and 1602.

This step 302 can detect whether the valves are function properly or not. When the inlet regulator 1600 determines that the valves 1601 and 1602 return to their initial state (valve 1601 is closed and valve 1602 is open) and also no water flows through the valves, an "ok" signal is then sent to the coordinator 1530 indicating the valves 1601 and 1602 are properly closed and opened, respectively.

The steps 301 and 302 not only perform water inlet and water shut off for purposes of checking the pumps, but also for purposes of checking the valves to prevent the malfunctioning of the fresh inlet valves, which could also lead to basement flooding. Any valve failure is detected and reported before there is the potential for any two of the valves to have failed. A manual valve at the inlet source can shut off the water flow when a valve repair is needed. The coordinator 1530 records the completion of step 302 into the record keeping module 1701; and activates the step 303.

As depicted in step 303, pump function is checked for all pumps. The coordinator 1530 turns on all the pumps (1203, 1202, and 1201B) through their control assemblies; specifically 1313H of 1313W, 1312H of 1312W, and 1311H of 1311W. The water level decreases with time to reach level 1313L to turn off the pump 1203. The water level shall then decrease with time to reach 1312L to turn off the pump 1202, if the pump 1202 was not running at the initial state. The water level shall then decrease with time to reach 1311L to turn off the pump 1201B, if the pump 1201B was not running at the initial state. When the pumps are activated one by one by the control assemblies to pump water and turned off one by one by the control assemblies to return to the initial state described above, the coordinator 1530 can conclude that the pumps and their control assemblies are functioning properly. The coordinator 1530 records the completion of step 303 into the record keeper 1701; and proceeds to step 304. As an alternative embodiment, one can directly equip each pump with one flow sensor to determine whether each pump and its control assembly is functioning properly or not.

As depicted in step 304, the pump subsystem is analyzed and reported about. The system check coordinator 1530 activates the system check analyzer 1510 to analyze the pumps based on the records produced in step 301 to step 303. Based on this analysis, the analyzer 1510 concludes as to whether the pumps are function properly and fill in a formatted report as designed. When finished, the analyzer sends a signal for the coordinator 1530 to activate the message delivery module 1702 to deliver the report to all people concerned via predetermined means such as e-mail, TWITTER, or phone messages.

Figure 4:
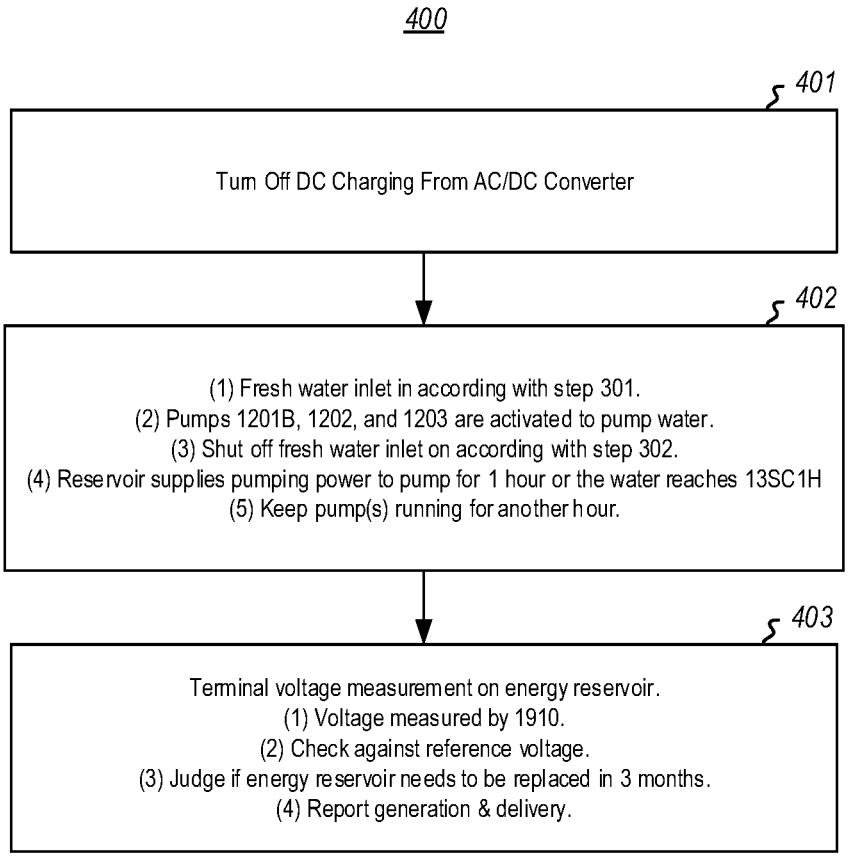
FIG. 4 illustrates a flowchart of a method for checking an energy reservoir in accordance with the principles described herein.

Section Five: Energy Reservoir Check:

When the time for the scheduled energy reservoir checking arrives, the system control 1300 activates the system check coordinator 1530 to perform the checking sequential block diagram depicted in FIG. 4.

As depicted in the step 401, the DC charge inlet power of the AC/DC converter is turned off. As depicted in step 402, fresh water is taken in in accordance with the step 301 of the pump check described above. In other words, fresh water is taken in through the valves 1601 and 1602 (which are again at the control of respective switches 1461 and 1462) such that the water level activates at least two of the pumps 1201B, 1202, and 1203. The water inlet is then turned off in accordance with the procedure described above for step 302 of the pump check. After the energy reservoir supplies the pumping power of the three pumps for about an hour or after the water level reaches 13SC1H, the pump(s) is/are kept running for another hour before proceeding to the next step 403.

As depicted in the step 403, the coordinator 1530 activates the regulator to measure the terminal voltage and determine whether or not the energy storage level is larger than 60%. If it is larger than 60%, the reservoir is functioning properly. If it is smaller than 60%, the reservoir needs to be replaced by a new reservoir in about one to three months.

The charge/discharge regulator 1900 is designed in a robust way and monitored continuously by the monitoring module 1520. Accordingly, in some embodiments, the charge/discharge regulator is not checked. Other subsystems are commercially available units, including the AC/DC converter. They shall be maintained and check in according with the guidelines specified in their user's manual. Thus, they are not included in the specified system check of this disclosure.

Section Six: System Monitoring:

The stated system-check and communication devices 1500, 1700 can perform not only scheduled system checks and resulting reporting, but may also perform real-time checks and send out proper messages as important incidents are detected (e.g., pump-failure in the middle of normal operation, grid power outage, the water influx rate exceeding the maximum pump system's capacity) to a list of owner specified phone numbers. Accordingly, someone can judge that what action should be taken to mitigate the upcoming consequence (such as rushing to the house to contain the water damage at its early stage; or no immediate action needed but call for repair or replacement help in a month; or other action).

For instance, the module 1310G may monitor and report grid power outage and recovery in real time. Therefore, the owner specified people receive this information via owner specified channels. The pumps are also monitored in real time. When any pump failure occurs, it will report to the owner specified people via owner specified communication channels. A water level assembly 13OF1 is placed near and above the assembly 13SC1 level; such that when an abnormal flooding rate enters into the well, such is detected and reported to the owner specified people via owner specified communication channels.

To alleviate the issue of unpleasant odors emitting from stagnant water in the sunk-well stated in the background section, an automatic water flushing regulator 1350 flushes the sunk well periodically with a time clock. When pumps are not running, the clock is counting to a preset time period. If the preset time period arrives after the last pump run, flushing is initiated. To avoid fresh water waste, the flushing schedule can be arranged to coincide with the system-check schedules. For instance, whenever the regulator decides to flush the sunk well, the system check performs the pump check. After every system check performed, the clock of the 1350 shall be reset to initiate the counting.

Section Seven: Other Benefits:

The proposed principles herein can also correct at least two other shortcomings of the conventional pump system design. First, in the convention pump system, a single big pump is designed with a fixed pumping rate to handle the rarely occurred maximum anticipated water leak-in condition. As a result, during regular normal seeping, there is an induced periodic short pulsed start-then-stop motor-action that shorten the motor's life and also waste a lot of electric energy. On the other hand, the proposed design turns on/off the additional small pumps to better matching the seeping rate. Second, the single pump of the conventional design often has no spare pumping capacity to handle a larger than typical maximum designed leak-in rate (say, 36 gallons per minute). In contrast, the principles described herein proposes to have the total maximum pumping rate (say, 18 gallons per minute for each pump, 54 gallons per minute in total) which is a substantially bigger capacity than the single pump capacity; and also has built-in one assurance spare pump.

Section Eight: Elaboration on Other Subsystems

To elaborate on the power subsystem 1100, as depicted in FIG. 1B, the convertor 1800 converts high voltage AC to low voltage DC power, which is temporarily stored into an energy reservoir 1100. When grid power is normal, the combined DC power from the convertor and the reservoir operates the pump system including the DC pumps 1201, 1202, and 1203. While grid power is out, the energy reservoir alone powers the system directly in a low voltage DC form within a designed time-duration (no invertor needed).

This power subsystem operates with built-in sensors to check itself in real-time; and the vitality of the reservoir also regularly checked by the system-check coordinator 1530 as described above. Therefore, the vitality of the UPS energy reservoir during grid power outage can be assured.

The principles described herein propose that the converter 1800 is purchased from commercial market; which is safety certified (with UL and CE), and designed to be water-proof; or to be located at a place free of water. All the other subsystems, devices, modules, and motors are proposed to operate with low voltage DC power. Thus, the safety from fatal electrocution of this pump system as well as its UPS energy reservoir can be assured.

To elaborate on the water pump subsystem 1200, as depicted in FIG. 1B, multiple smaller pumps 1201, 1202, and 1203 may be low voltage DC powered (say, either 36, 24, or 12 volts) that are free from electrocution dangers. The pump motors are DC motors such as simple blushless DC motor or variable frequency blushless DC motor.

The water pumps can be mounted at the bottom of the well at the same height; or mounted inside the well with different height; or mounted above the well. These water pumps shall be activate by the water level sensors 1310W to start/stop water pumping. For instant, the water pump 1201B is activated by water level sensor 1311H to start water pumping and activated by 1311L to stop pumping; the water pump 1202 is activated by water level sensor 1312H to start water pumping and activate 1312L to stop pumping; and so forth. In another embodiment, when the pumps are mounted at the same height or above the well, the water level sensors can send their signals to the device 1310W; and the device 1310W can be designed to determine which pump to be turned on or turned off.

Among the designed functions, the system-checking device 1500 can perform periodic system checking on all standby functions in accordance with a designed procedure. The devices 1300B and 1500 combined can also monitors system's operating functions in real time; including grid power is normal or outage, the convertor is delivering DC power or not, the pump is fail in mid of operation or not, etc. The communication device 1700 can deliver these findings via proper messages at proper time to proper persons.

The device 1900 is designed to properly regulate the UPS' charging by grid power conversion and discharging to the pump system. As an example, when energy storage of the energy reservoir reaches or exceeds 95%, the regulator 1360 stops the charging until the energy reservoir declines to or below 75% storage, at which time the regulator 1900 again allows charging. On the other hand, when the energy reservoir storage level declines to 5% or below, the regulator 1900 stops the discharging; until the charge is recovered to at or above 15% of energy storage, at which time the regulator 1900 again allows discharging. In doing so, the regulator prevents the battery over-charging and over-draining; such that the reservoir's batteries are well protected to have their designed long life.

All the electronic signals between sensors, regulators, and switches can be sent via standard industrial electronic communication cables, or via wireless gear such as the bluetooth; or being translate into optical signals and using optical cable for mutual communication among these devices.

Section Nine: Embodiment Describing the Specifics of the System Check

The descriptions in the previous sections are focused on describing devices' functionality and the designed process procedures for logic modules; i.e. to describe "what the devices can do" in the system check division. This section uses a practical embodiment to illustrate the specifics of the key hard-wares and soft-wares to directly describe "what they can be". The names or terms of devices used in the claims herein are also defined.

For description purpose without losing generality, this embodiment assumes a design in which two water pumps can adequately evacuate the maximum anticipated water seepage; and the third pump is to be the assurance redundant spare pump.

Figure 5:
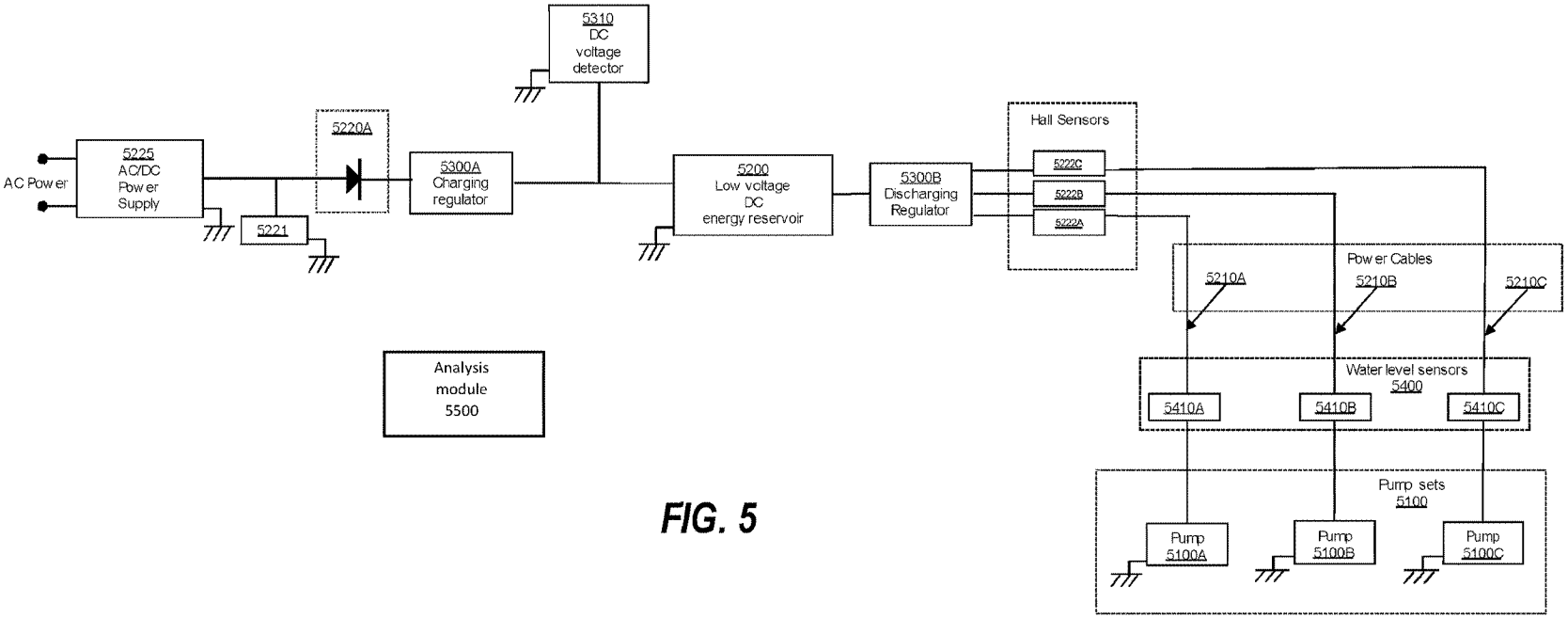
FIG. 5 illustrates an embodiment to that shows hardware and software in an example pump system designed in accordance with the principles described herein.

FIG. 5 illustrates a pump system in accordance with the principles described herein for a basement sunk-well to evacuate the water seepage. The pump system 5000 consists of a pump set 5100 consisting of multiple pumps; three blushless DC water pumps 5100A, 5100B, and 5100C, in this case. Each pump is powered by a common low voltage (say, less than 60 volts) DC energy reservoir 5200 through three pairs of cables 5210A, 5210B, and 5210C. Cable-pair 5210A feeds power to the pump 5100A, cable-pair 5210B feeds power to the pump 5100B, and cable-pair 5210C feeds power to the pump 5100C. The pump set that is properly connected to a lower voltage DC reservoir as described, is named as the pump set subsystem herein.

As illustrated in FIG. 5, every cable-pair is also equipped with a HALL sensor to monitor whether the power cable is delivering electric current; i.e. whether the motor of the pump is running or not. HALL sensor 5222A monitors cable-pair 5210A, HALL sensor 5222B monitors cable-pair 5210B, and HALL sensor 5222C monitors cable-pair 5210C. The monitor HALL sensors, 5222A, 5222B, and 5222C send out high/low signals in real time accordingly. These signals are received by the equipped analysis module 5500 of the pump system 5000 for further processes. The processes of the analysis module 5500 will be described later.

Figure 6A:
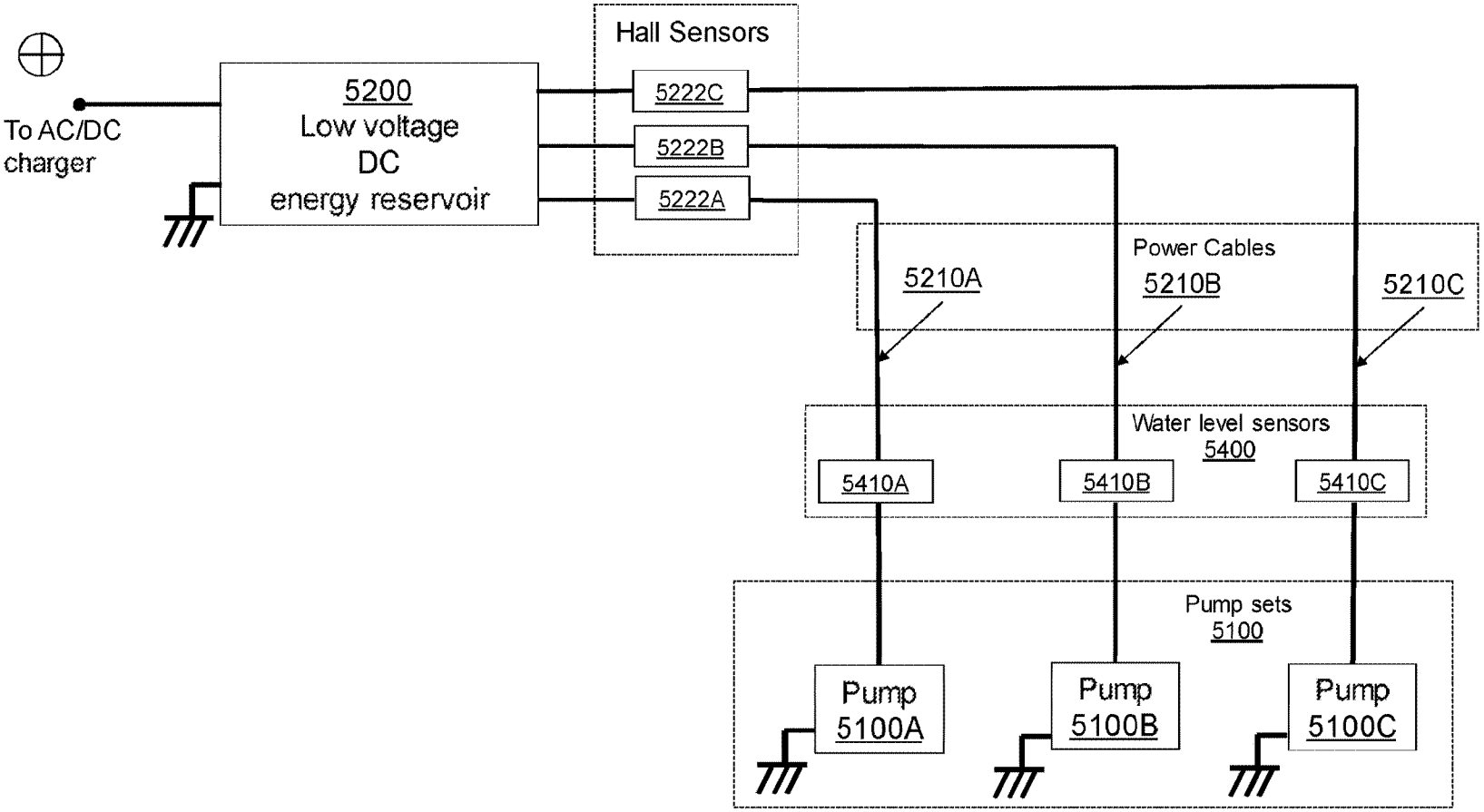
FIG. 6A redraws and depicts the portion in FIG. 5 that shows the pump-detection subsystem.

For clarity, FIG. 6A depicts in further detail the portion of FIG. 5 that shows connections of the pump set subsystem 5100, the low voltage DC energy reservoir 5200, the power feeding cables 5210A, 5210B, 5210C, and the pump-detection subsystem 5222A, 5222B, 5222C of the pump system 5000. Specifically, the portion depicted in FIG. 6A is a complete set supporting a set of HALL sensors that capable of detecting whether each pump is running or not. This complete set is named as the pump-detection subsystem herein.

Figure 6B:
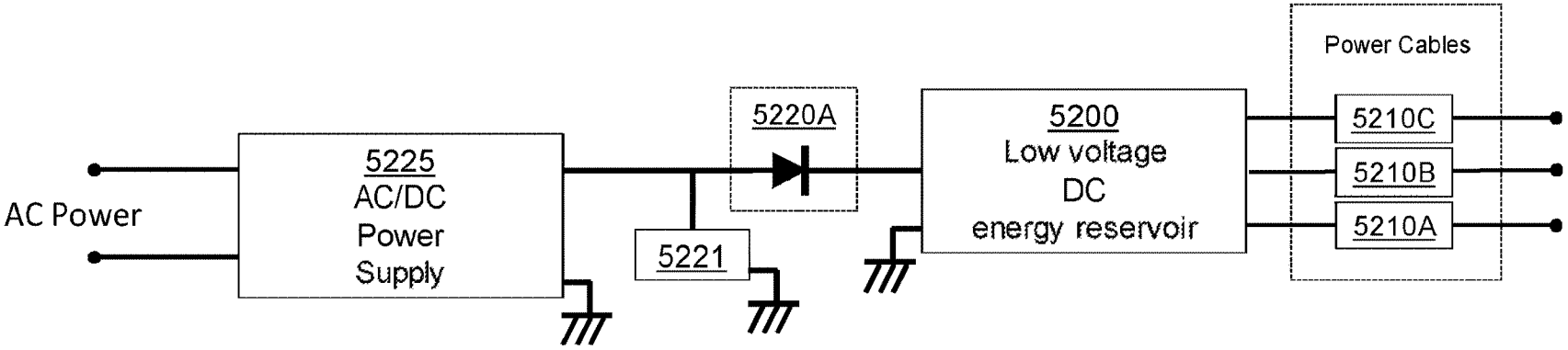
FIG. 6B redraws and depicts the portion in FIG. 5 that shows the AC power outage/recovery detection subsystem.

As illustrated in FIG. 5, the common low voltage DC energy reservoir 5200 is consist of batteries and capacitors. As depicted in FIG. 6B, the reservoir is charged by an AC/DC power supply 5225 through a decouple diode 5220A. A DC voltage detection device 5221 detects the high/low DC voltage before the current entering decouple diode 5220A in a real time manner. This DC voltage detection device 5221 is function as the sensor to detect the AC power outage; or AC power recovery. Presence of a high DC voltage (say, >62 volts for 60 volts reservoir) at the sensing point indicates the presence of AC power of the AC power grid. The DC voltage detection device 5221 also sends out high/low signals to inform the presence or absence of AC power in the AC power grid to the system. These signals are received by the equipped analysis module 5500 of the pump system 5000 for further processes. The processes of the analysis module 5500 will be described later.

For clarity, FIG. 6B depicts in further detail the portion of FIG. 5 that shows connections of the reservoir 5200, the AC end of AC/DC power supply 5225, and the DC end of the AC/DC power supply 5225 charging the reservoir through a decouple diode 5220A; and the DC voltage detection device 5221 detects the high/low DC voltage before the current entering decouple diode 5220A. Specifically, the portion depicted in FIG. 6B is a complete set for the DC voltage detector 5221 to detect the presence or absence of AC power described above. This complete set is named as the AC power outage/recovery detection subsystem of the pump system 5000 herein.

As illustrated in FIG. 5; to assure an adequate energy stored in the reservoir at the beginning of every AC power outage occurrence, a regulator 5300 (comprising charging regulator 5300A and discharging regulator 5300B) is designed to properly regulate the charging of the energy reservoir 5200 by the AC/DC power supply 5225 connecting to the AC power grid, as well as discharging to the pumps. As an example, the regulator 5300 comprises a real time DC voltage detector 5310 to monitor the stored energy level of the energy reservoir by measuring the terminal voltage of the reservoir. When the terminal voltage of the energy reservoir reaches or exceeds the voltage corresponding to 95% of the battery storage, the regulator 5300A stops the charging until the terminal voltage of the energy reservoir declines to or below corresponding to 80% of the battery storage, at which time the regulator 5300 again allows charging. Ordinary circuitry design skills can be employed to derive the functions required of the regulator 5300A, 5300B, and the voltage detector 5310. These circuit designs are current employed in many commercial products of the LT Lighting (Taiwan) Corporation. The complete set of the regulator 5300A and 5300B associated with the voltage detector 5310 that can be employed to assure the adequate energy storage to support the pump system at AC power outage. This complete set is named as the stored energy assurance subsystem of the pump system 5000 herein.

On the other hand, when AC power outage occurs, the DC voltage detector 5310 can detect the energy storage level being drain by the pumps. When the detected declining voltage reaches a voltage corresponding to an energy level of 5% or below, the regulator 5300B stops the power discharging. When the AC power recovers, the energy reservoir is recharged again by the AC/DC power supply 5225. Then the detector 5310 detects a voltage corresponding to the battery storage level recovered to above 25% of energy storage, at which time the regulator 5300B allows discharging again. In doing so, the regulator 5300 can also prevent the battery from over-charging and over-draining.

The regulator 5300 can also send out signals at each designed terminal voltage detection point corresponding to a specific percentage energy storage of the reservoir. The related signals are received by the equipped analysis module 5500 of the pump system 5000 for further processes. These processes of the will be described later.

Figure 6C:
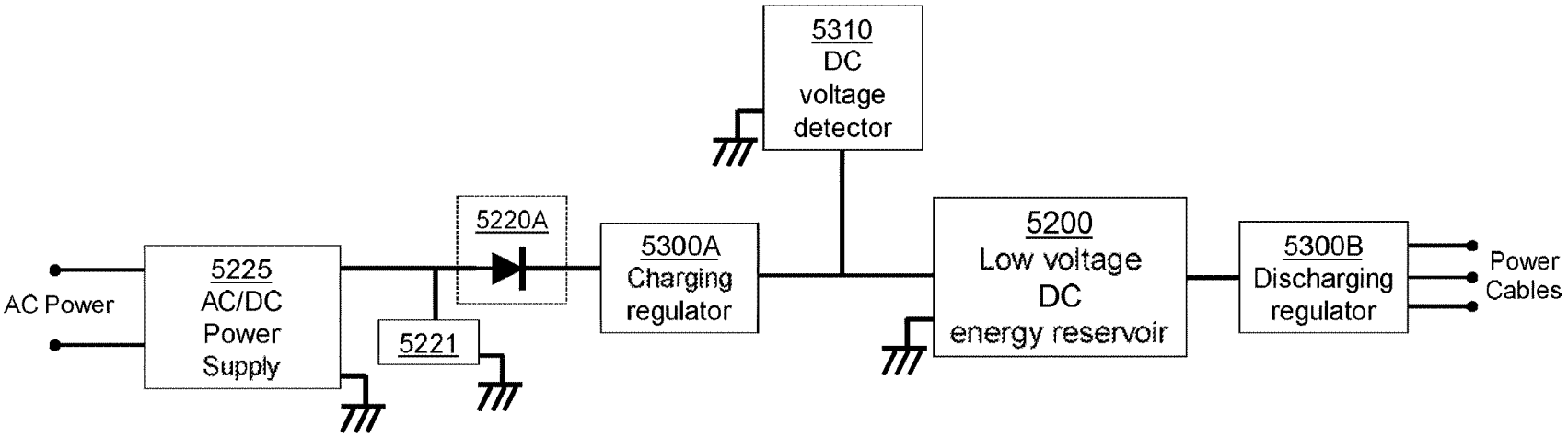
FIG. 6C redraws and depicts the portion in FIG. 5 that shows the reservoir's energy level detection subsystem.

For clarity, FIG. 6C redraws and depicts the portion of FIG. 5 that shows connections of the AC end of AC/DC power supply 5225, the reservoir 5200, and the charging regulator 5300A, the discharging regulator 5300B, and the DC voltage detector 5310. Specifically, the portion depicted in FIG. 6C is a complete set for the charging-discharging regulator 5300 to regulate the low voltage DC energy reservoir 5200 described above. The ensemble of regulator 5300, the DC voltage detector 5310, and signals generators at each designed voltage point is referred to as the reservoir's energy level detection subsystem herein.

As illustrated in FIG. 5; each pump can be activated and deactivated by high/low signals received from a water sensor. The set of water level sensors 5400 is designed to locate inside the sunk-well. For instance, sensors 5410A (located lowest), 5410B (higher), 5410C (even higher), and 5410D (highest) that can detect the different water levels and send out high/low signals. For instance, the sensor would send out a high signal, when water level is higher than the location of the sensor; and the sensor would send out a low signal, when water level is lower than the location of the sensor.

As described below, each water level sensor can send out high/low signal for specific functional purpose. For instance, the high signal send out from sensor 5410A can activate the pump 5100A; the low signal send out from sensor 5410A can deactivate the pump 5100A. Also, the high signal send out from sensor 5410B can activate the pump 5100B; the low signal send out from sensor 5410B can deactivate the pump 5100B. The high signal send out from sensor 5410C can activate the pump 5100C; the low signal send out from sensor 5410C can deactivate the pump 5100C.

Notice that the high signal send out from the sensor 5410D will trigger the pump system 5000 to alert the basement occupants, or house owners, or caretakers; to inform them that the water level reached the level at which some measure is needed to mitigate the situation. On the other hand, the low signal sent out from the sensor 5410D is to inform the pump system 5000 that the seepage water is properly handled by the pumps; and thus that there is no need to disturb the basement occupants, or house owners, or caretakers. All these water level signals are also received by the equipped analysis module 5500 of the pump system 5000 for further processes. These processes will be described later. The ensemble of the described the set of water level sensors 5400 and their signal generation is referred to as the water level detection subsystem of the pump system 5000 herein.

Figure 7:
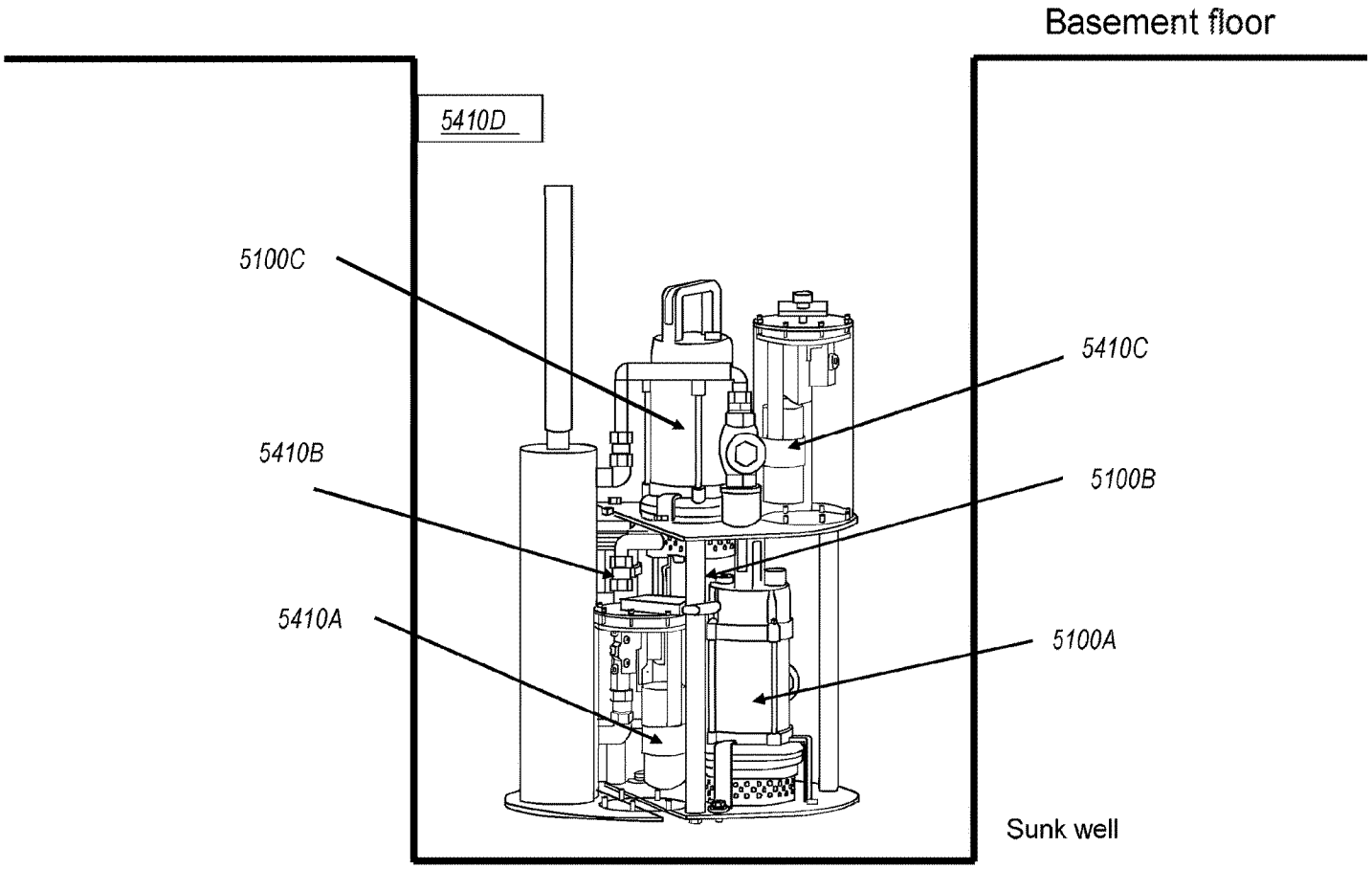
FIG. 7 depicts a multi-pump system situated within a basement sunk-well, and which shows example locations of the water sensors in a basement sunk-well, where the locations are relative locations, and is not to scale.

For clarity, FIG. 7 draws and depicts the locations of the water sensors 5410A, 5410B, 5410C, and 5410D in an example basement sunk-well. This Figure only shows the relative locations of these water sensors; and is not to scale. The pumps 5100A, 5100B, 5100C can be located either in the well or outside of the well; as long as their water suction points is under the water level that allows them to pump the water inside the well.

The above referred equipped analysis module 5500 of the pump system 5000 (in FIG. 5) receives all signals described above for further process. This means that the module 5500 is a logic program unit that processes information received to make judgments and decisions, and to generate needed actions designed. Some of the received single detection signals may directly trigger command action: For example, when module 5500 receives a high signal from the sensor 5410D, it will immediately trigger the pump system 5000 to alert the basement occupants, or house owners, or caretakers; to inform them via proper communication channels that the water level reached the level at which some measure is needed to mitigate the situation. This communication may include the specified sounding buzzers, send out brief messages, TWEETS, etc. As another example, when AC power outage or recover occur the pump system 5000 will immediately follow the design command to alert or inform (via proper communication channels) the specified individuals. There are other cases that would require more than one signal to make a logical determination; followed by proper command and action. For instance, suppose the signal from the reservoir's energy level detection subsystem indicates the reservoir is ready for discharge, and the signal from water sensor 5410A is high indicating the pump 5100A is activated, but the signal sent out from HALL sensor 5222A is low indicating the pump 5100A is not running. The module 5500 would determine that the pump 5100A has malfunctioned followed by the design command to alert or inform (via proper communication channels) the specified individuals about the situation. The same applies for the pump 5100B or the pump 5100C. As illustration examples, the Table 1 below presents a list of probable scenarios prescribed and the logical conclusions the logic program of the analysis module would derive under the situations.

TABLE 1

Example Logic of Analysis Module

| Scenarios No. | AC power detection signal | Energy reservoir level signal | Water level detection signal | Pump detection signal | Logic conclusions of Analysis module |
|---|---|---|---|---|---|
| 1 | L | N/A | N/A | N/A | AC power outage occur |
| 2 | L | H | 5410A(H) | 5222A(H) | AC power is out |
| | | | 5410B(L) | 5222B(L) | The pump system run on UPS |
| | | | 5410C(L) | 5222C(L) | Seepage rate is low |
| 3 | L | H | 5410A(H) | 5222A(H) | AC power is out |
| | | | 5410B(H) | 5222B(H) | The pump system run on UPS |
| | | | 5410C(L) | 5222C(L) | Water seepage rate is high |
| 4 | L | H | 5410A(H) | 5222A(H) | AC power is out |
| | | | 5410B(H) | 5222B(H) | The pump system run on UPS |
| | | | 5410C(H) | 5222C(H) | Water seepage rate exceeds the anticipated maximum, care taking is required |
| 5 | H | H | 5410A(H) | 5222A(L) | Pump 5100A malfunction, care taking required |
| | | | 5410B(H) | 5222B(H) | |
| | | | 5410C(L) | 5222C(L) | Water seepage rate is normal Pump 5100B is running |

TABLE 1-continued

Example Logic of Analysis Module

| Scenarios No. | AC power detection signal | Energy reservoir level signal | Water level detection signal | Pump detection signal | Logic conclusions of Analysis module |
|---|---|---|---|---|---|
| 6 | H | H | 5410A(H)<br>5410B(H)<br>5410C(H) | 5222A(L)<br>5222B(H)<br>5222C(H) | Pump 5100A malfunction, care taking required<br>Water seepage rate is high<br>Pump 5100B & 5100C are running |
| 7 | N/A | N/A | 5410D(H) | N/A | Water level is extremely high that require care taking immediately |
| 8 | H | H | 5410A(H)<br>5410B(H)<br>5410C(H) | 5222A(H)<br>5222B(L)<br>5222C(H) | Water seepage rate (High)<br>Pump 5100B malfunction, care taking required |
| 9 | L | L | 5410A(H)<br>5410B(H)<br>5410C(L) | 5222A(H)<br>5222B(H)<br>5222C(L) | AC power out<br>Energy reservoir almost running out of juice<br>Water seepage rate is high<br>Pump 5100A & 5100B are running<br>Needs to take care the energy reservoir immediately |
| 10 | H | L | 5410A(H)<br>5410B(H)<br>5410C(H) | 5222A(L)<br>5222B(L)<br>5222C(L) | Energy reservoir run out of juice<br>Care taking required immediately |
| 11 | L → H | N/A | N/A | N/A | AC power recovered |

When the caretaker of the pump system wants to check the whole system, he can manually let in fresh water to reach a water level higher than the location of water sensor 5410D. The system will alert the excess of water level first. The inlet water needs to be stopped manually. The system can then check the pumps to see if any of the three is malfunction. If they are all alright, the caretaker can then switch off the AC power inlet to the power AC/DC power supply 5225. The system should immediately or quickly inform of the AC power outage. The caretaker can then switch on the AC power inlet to the power supply 5225 again. The system should quickly inform that the AC power is recovered. In performing the system check manually as described, the caretaker can find out the status of the system: either that they are all ok, or that any malfunction occurred; and he or she can then take the proper action to maintain the system accordingly.

An automatic system check can be designed by adding an electromagnetic water valve to make the water inlet and stop the water inlet properly. Also to add the needed logic program to the analysis module 5500 such that the results of the system check can be derived from the response of the system to the monitor signals received by the analysis module 5500.

In other words, the analysis module 5500 is a logic program unit designed to collect, to combine, and to sort out all the received monitor signals to derive a logic conclusion in accordance with the programed logics. To describe it in different way, the analysis module 5500 performs checking analysis and then generates proper command, control, and communication signals to conduct followed actions derived from the module 5500.

Specifically, the complete check-system in according to the principles described herein can be a system comprising the pump-detection subsystem, the reservoir's energy level detection subsystem, and the analysis module. However, the AC power outage/recovery detection subsystem is essential should be included; while the stored energy assurance subsystem is very helpful to make the pump system in excellent shape when incorporated into the check-system.

Section Ten: A Computing System

Because some of the components described herein (e.g., the analysis module 5500) may operate in the context of a computing system, a computing system will be described with respect to FIG. 8. Computing systems are now increasingly taking a wide variety of forms. Computing systems may, for example, be handheld devices, appliances, laptop computers, desktop computers, mainframes, distributed computing systems, datacenters, or even devices that have not conventionally been considered a computing system, such as wearables (e.g., glasses, watches, bands, and so forth). In this description and in the claims, the term "computing system" is defined broadly as including any device or system (or combination thereof) that includes at least one physical and tangible processor, and a physical and tangible memory capable of having thereon computer-executable instructions that may be executed by a processor. The memory may take any form and may depend on the nature and form of the computing system. A computing system may be distributed over a network environment and may include multiple constituent computing systems.

Figure 8:
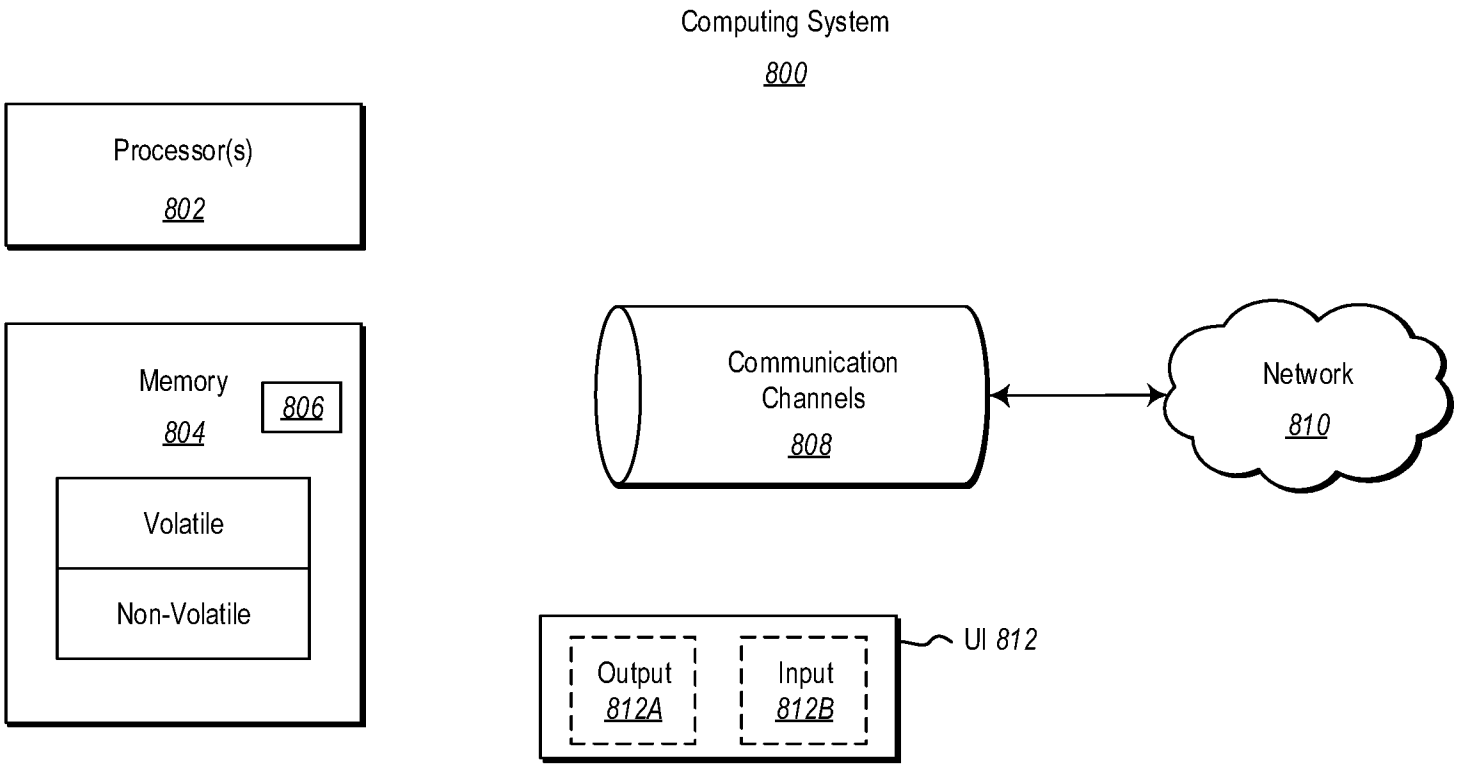
FIG. 8 illustrates a configuration of a computing system that may be used to perform some aspects described herein, including the analyzer module.

As illustrated in FIG. 8, in its most basic configuration, a computing system 800 typically includes at least one hardware processing unit 802 and memory 804. The memory 804 may be physical system memory, which may be volatile, non-volatile, or some combination of the two. The term "memory" may also be used herein to refer to non-volatile mass storage such as physical storage media. If the computing system is distributed, the processing, memory and/or storage capability may be distributed as well.

The computing system 800 has thereon multiple structures often referred to as an "executable component". For instance, the memory 804 of the computing system 800 is illustrated as including executable component 806. The term "executable component" is the name for a structure that is well understood to one of ordinary skill in the art in the field of computing as being a structure that can be software, hardware, or a combination thereof. For instance, when implemented in software, one of ordinary skill in the art would understand that the structure of an executable component may include software objects, routines, methods that may be executed on the computing system, whether such an executable component exists in the heap of a computing system, or whether the executable component exists on computer-readable storage media.

In such a case, one of ordinary skill in the art will recognize that the structure of the executable component exists on a computer-readable medium such that, when interpreted by one or more processors of a computing system (e.g., by a processor thread), the computing system is caused to perform a function. Such structure may be computer-readable directly by the processors (as is the case if the executable component were binary). Alternatively, the structure may be structured to be interpretable and/or compiled (whether in a single stage or in multiple stages) so as to generate such binary that is directly interpretable by the processors. Such an understanding of example structures of an executable component is well within the understanding of one of ordinary skill in the art of computing when using the term "executable component".

The term "executable component" is also well understood by one of ordinary skill as including structures that are implemented exclusively or near-exclusively in hardware, such as within a field programmable gate array (FPGA), an application specific integrated circuit (ASIC), or any other specialized circuit. Accordingly, the term "executable component" is a term for a structure that is well understood by those of ordinary skill in the art of computing, whether implemented in software, hardware, or a combination. In this description, the term "component" or "vertex" may also be used. As used in this description and in the case, this term (regardless of whether the term is modified with one or more modifiers) is also intended to be synonymous with the term "executable component" or be specific types of such an "executable component", and thus also have a structure that is well understood by those of ordinary skill in the art of computing. The analysis module 5500 may be an executable component. In addition, any of the modules, components, and analyzers that are described herein may likewise be an executable component.

In the description above, embodiments are described with reference to acts that are performed by one or more computing systems. If such acts are implemented in software, one or more processors (of the associated computing system that performs the act) direct the operation of the computing system in response to having executed computer-executable instructions that constitute an executable component. For example, such computer-executable instructions may be embodied on one or more computer-readable media that form a computer program product. An example of such an operation involves the manipulation of data.

The computer-executable instructions (and the manipulated data) may be stored in the memory 804 of the computing system 800. Computing system 800 may also contain communication channels 808 that allow the computing system 800 to communicate with other computing systems over, for example, network 810.

While not all computing systems require a user interface, in some embodiments, the computing system 800 includes a user interface 812 for use in interfacing with a user. The user interface 812 may include output mechanisms 812A as well as input mechanisms 812B. The principles described herein are not limited to the precise output mechanisms 812A or input mechanisms 812B as such will depend on the nature of the device. However, output mechanisms 812A might include, for instance, speakers, displays, tactile output, holograms, virtual reality, and so forth. Examples of input mechanisms 812B might include, for instance, microphones, touchscreens, holograms, virtual reality, cameras, keyboards, mouse of other pointer input, sensors of any type, and so forth.

Embodiments described herein may comprise or utilize a special purpose or general-purpose computing system including computer hardware, such as, for example, one or more processors and system memory, as discussed in greater detail below. Embodiments described herein also include physical and other computer-readable media for carrying or storing computer-executable instructions and/or data structures. Such computer-readable media can be any available media that can be accessed by a general purpose or special purpose computing system. Computer-readable media that store computer-executable instructions are physical storage media. Computer-readable media that carry computer-executable instructions are transmission media. Thus, by way of example, and not limitation, embodiments can comprise at least two distinctly different kinds of computer-readable media: storage media and transmission media.

Computer-readable storage media includes RAM, ROM, EEPROM, CD-ROM or other optical disk storage, magnetic disk storage or other magnetic storage devices, or any other physical and tangible storage medium which can be used to store desired program code means in the form of computer-executable instructions or data structures and which can be accessed by a general purpose or special purpose computing system.

A "network" is defined as one or more data links that enable the transport of electronic data between computing systems and/or components and/or other electronic devices. When information is transferred or provided over a network or another communications connection (either hardwired, wireless, or a combination of hardwired or wireless) to a computing system, the computing system properly views the connection as a transmission medium. Transmissions media can include a network and/or data links which can be used to carry desired program code means in the form of computer-executable instructions or data structures and which can be accessed by a general purpose or special purpose computing system. Combinations of the above should also be included within the scope of computer-readable media.

Further, upon reaching various computing system components, program code means in the form of computer-executable instructions or data structures can be transferred automatically from transmission media to storage media (or vice versa). For example, computer-executable instructions or data structures received over a network or data link can be buffered in RAM within a network interface component (e.g., a "NIC"), and then eventually transferred to computing system RAM and/or to less volatile storage media at a computing system. Thus, it should be understood that readable media can be included in computing system components that also (or even primarily) utilize transmission media.

Computer-executable instructions comprise, for example, instructions and data which, when executed at a processor, cause a general-purpose computing system, special purpose computing system, or special purpose processing device to perform a certain function or group of functions. Alternatively, or in addition, the computer-executable instructions may configure the computing system to perform a certain function or group of functions. The computer executable instructions may be, for example, binaries or even instructions that undergo some translation (such as compilation) before direct execution by the processors, such as intermediate format instructions such as assembly language, or even source code.

Those skilled in the art will appreciate that the invention may be practiced in network computing environments with many types of computing system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, datacenters, wearables (such as glasses or watches) and the like. The invention may also be practiced in distributed system environments where local and remote computing systems, which are linked (either by hardwired data links, wireless data links, or by a combination of hardwired and wireless data links) through a network, both perform tasks. In a distributed system environment, program components may be located in both local and remote memory storage devices.

Those skilled in the art will also appreciate that the invention may be practiced in a cloud computing environment, which is supported by one or more datacenters or portions thereof. Cloud computing environments may be distributed, although this is not required. When distributed, cloud computing environments may be distributed internationally within an organization and/or have components possessed across multiple organizations.

In this description and the following claims, "cloud computing" is defined as a model for enabling on-demand network access to a shared pool of configurable computing resources (e.g., networks, servers, storage, applications, and services). The definition of "cloud computing" is not limited to any of the other numerous advantages that can be obtained from such a model when properly deployed.

For instance, cloud computing is currently employed in the marketplace so as to offer ubiquitous and convenient on-demand access to the shared pool of configurable computing resources. Furthermore, the shared pool of configurable computing resources can be rapidly provisioned via virtualization and released with low management effort or service provider interaction, and then scaled accordingly.

A cloud computing model can be composed of various characteristics such as on-demand, self-service, broad network access, resource pooling, rapid elasticity, measured service, and so forth. A cloud computing model may also come in the form of various application service models such as, for example, Software as a service ("SaaS"), Platform as a service ("PaaS"), and Infrastructure as a service ("IaaS"). The cloud computing model may also be deployed using different deployment models such as private cloud, community cloud, public cloud, hybrid cloud, and so forth. In this description and in the claims, a "cloud computing environment" is an environment in which cloud computing is employed.

Section Eleven: Summary

To summarize, the principles described herein propose to use multiple smaller pumps in the pumping subsystem 1200B, in lieu of the single big pump design as in the conventional pump system.

The principles described herein equipped monitor devices to perform necessary detections and send out signals to indicate the state or status of each key subsystem.

The principles described herein describe an analysis module, a logic program unit that receives the monitor signals. This analysis module collects, combines, and sorts out all the received monitor signals and to process the contented information of these signals; to derive logic conclusions in accordance with the programed logics. To describe it in different way, the analysis module 5500 performs checking analysis and then generates proper command, control, and communication signals so that certain actions are conducted. More particular, such signals may be send messages to the owner (or specified persons via the owner) via specified communication channels at every important incident occurrence.

The principle described herein further design for the total capacity of the smaller pumps to be bigger than the capacity at the anticipated worst case scenario; preferably to add one more pump as the assurance spare. Therefore, there will be almost no chance for basement water damage to happen when grid power is normal.

The principles described herein further propose to convert high voltage AC power to a low voltage DC power and also to temporarily store the DC energy into an energy reservoir; such that the pump system is operated at low voltage DC form. The designed energy storage capacity of the reservoir shall support system's operation for a desired duration time. The principles described herein therefore propose to use low voltage DC pumps in its pumping subsystem to realize the embodiments without any inverter.

The principles further suggest that the AC/DC convertor, which converts high voltage AC to the low voltage DC power; either be located at a location free from flood-water, or should be fabricated with water-proof design. By doing so, it can assure the system not only is safe and free from high voltage electrocution accidents, but also provides a reliable UPS energy to sustain the pumping function during a period of grid power outage.

A charge/discharge regulator is also incorporated; not only to regulate the reservoir to be properly charged and discharged, but also to assure the energy storage level of the reservoir is keep to above the designed level ready for providing energy supply to evacuate designed amount of water seepage during each AC power outage. This not only assures the ability of energy support to endure grid power outage, but also assures the long lifetime of the batteries.

As stated above, when incorporate the principles described herein, there would be almost no chance of having water damage to occur either with normal grid power or during grid power outage. Notice that a term, "well" is used hereinafter that covers all wells including the basement sunk well used above; or any container at the lower ground relative to the location receiving the liquid (water) that to be pumped.

While the system described above is referred as a "water" pump system, many modifications and changes can occur in those skilled in the art; such as one can design a pump system to pump liquid from a lower location to a higher location and overcoming similar obstacles described above. Or a pump system to pump water from water well to a tank (reservoir) with certain water head using the principle described herein to obtain certain desired benefits. It is, therefore, to be understood that the appended claims are intended in cover all such modifications and changes as full within the spirit of the invention; and the term "liquid" is thus used to replace "water" in the claims.

The present invention may be embodied in other specific forms without departing from its spirit or essential characteristics. The described embodiments are to be considered in all respects only as illustrative and not restrictive. The scope of the invention is, therefore, indicated by appended claims rather than by the forgoing description. All changes which come within the meaning and range of equivalency of the claims are to be embraced within their scope.

The invention claimed is:

1. A liquid pump system comprising:

a plurality of liquid pumps that are powered by a common low voltage DC energy reservoir to pump a liquid;

an AC/DC power supply to convert AC power from an AC electric power source, into a low voltage direct current to charge the low voltage DC energy reservoir;

an energy level detection subsystem for the low voltage DC energy reservoir configured to determine a percentage of energy remaining in the low voltage DC energy reservoir and send signals to indicate when the low voltage DC energy reservoir reaches a specified percentage of stored energy;

a set of liquid level sensor subsystems configured to turn on each of the plurality of liquid pumps one at a time as a liquid level rises, and configured to turn off each of the plurality of liquid pumps one at a time as the liquid level lowers;

a pump-detection subsystem configured to detect whether each specific pump of the plurality of liquid pumps is running or not and also to send detection signals to indicate the operating status of each said specific pump; and an analysis module configured to receive the detection signals and in response to a high level signal perform real time checks of the plurality of liquid pumps to verify proper operation of the plurality of liquid pumps, and configured to cause communications to be transmitted to one or more recipients when the analysis module detects improper operation of a subset of the plurality of liquid pumps.

2. The liquid pump system in accordance with claim 1, further comprising:

an AC power outage/recovery detection subsystem configured to detect AC power outage/recovery occurrences and send signals to indicate the occurrences.

3. The liquid pump system in accordance with claim 1, wherein the liquid is water.

4. The liquid pump system in accordance with claim 1, wherein a number of the plurality of liquid pumps is one more than that required to have a pumping rate equal to or exceeding an anticipated maximum seepage rate.

5. The liquid pump system in accordance with claim 1, further comprising:

a stored energy assurance subsystem to assure the liquid pump system has adequate energy storage in the low voltage DC energy reservoir to evacuate a designed amount of water seepage.

6. The liquid pump system in accordance with claim 1, wherein the AC electric power source comprises an AC power grid.

7. The liquid pump system in accordance with claim 1, wherein the AC electric power source comprises an auxiliary power source, including a gasoline generator or a diesel generator.

8. The liquid pump system in accordance with claim 1, wherein the AC electric power source comprises a low voltage AC power source.

9. The liquid pump system in accordance with claim 1, wherein the low voltage DC energy reservoir comprises at least one battery.

10. The liquid pump system in accordance with claim 1, wherein the low voltage DC energy reservoir comprises at least one battery and one capacitor.

11. The liquid pump system in accordance with claim 1, wherein at least one pump of the plurality of liquid pumps comprises a brushless DC motor.

12. The liquid pump system in accordance with claim 1, wherein at least two pumps of the plurality of liquid pumps are located at about the same horizontal level in a pump well.

13. The liquid pump system in accordance with claim 1, wherein none of the plurality of liquid pumps are located at different horizontal levels in a pump well.

14. The liquid pump system in accordance with claim 1, wherein at least one pump of the plurality of liquid pumps is located at a different horizontal level in a pump well.

15. The liquid pump system in accordance with claim 1, wherein at least one pump of the plurality of liquid pumps is located on or above the ground with respect to a pump well.

16. The liquid pump system in accordance with claim 1, wherein all the pumps of the plurality of liquid pumps are located at or above the ground with respect to a pump well.

17. The liquid pump system in accordance with claim 1, all of a plurality of liquid level sensors of the set of liquid level sensor subsystems are located inside of a pump well.

18. The liquid pump system in accordance with claim 1, at least one liquid level sensor of a plurality of liquid level sensors of the set of liquid level sensor subsystems are located above a bottom of a pump well.

19. The liquid pump system in accordance with claim 1, wherein all signals communication from the liquid pump system pass through electric cables.

* * * * *